United States Patent [19]

Henricson et al.

[11] Patent Number: 4,952,314

[45] Date of Patent: Aug. 28, 1990

[54] APPARATUS FOR TREATING PULP

[75] Inventors: Kaj O. Henricson, Kotka; Seppo K. Kokkonen, Savonlinna; Olavi E. Pikka, Karhula; Harri T. Qvintus; Erkki A. Ruuskanen, both of Savonlinna; Erkki E. Savolainen, Haapakallio, all of Finland

[73] Assignee: A. Ahlstrom Corporation, Noormarkku, Finland

[21] Appl. No.: 224,467

[22] Filed: Jul. 26, 1988

[30] Foreign Application Priority Data

Nov. 11, 1987 [FI] Finland ..... 874967

[51] Int. Cl.[5] ..... D21C 9/06

[52] U.S. Cl. ..... 210/404; 210/402; 162/60; 162/380; 68/148; 68/158; 68/181 R

[58] Field of Search ..... 162/60, 336, 338, 380, 162/246; 210/404, 392, 402, 403; 68/181 R, 158, 18 F, 148; 55/52, 203

[56] References Cited

U.S. PATENT DOCUMENTS

| | | | |
|---|---|---|---|
| 3,086,717 | 4/1963 | Vroom et al. . | |
| 3,296,066 | 1/1967 | Green et al. | 162/338 |
| 3,497,060 | 2/1970 | Tra et al. . | |
| 3,622,450 | 11/1971 | Attwood et al. | 162/339 |
| 3,823,063 | 7/1974 | Callahan et al. | 162/336 X |
| 4,014,736 | 3/1977 | Sexton . | |
| 4,135,966 | 1/1979 | Gloerson | 162/246 X |
| 4,266,413 | 5/1981 | Yli-Vakkuri | 162/380 X |
| 4,273,562 | 6/1981 | Niskanen | 55/52 |
| 4,435,122 | 3/1984 | Niskanen et al. . | |
| 4,596,631 | 6/1986 | Prough et al. | 162/52 |
| 4,632,729 | 12/1986 | Laakso | 162/17 |
| 4,750,340 | 6/1988 | Anderson | 162/60 X |
| 4,769,986 | 9/1988 | Kokkonen et al. | 162/60 X |

FOREIGN PATENT DOCUMENTS

| | | |
|---|---|---|
| 0056263 | 7/1982 | European Pat. Off. . |
| 8604369 | 7/1986 | European Pat. Off. . |
| 1298868 | 9/1967 | Fed. Rep. of Germany . |
| 75882 | 4/1988 | Finland . |
| 76132 | 5/1988 | Finland . |
| 1246630 | 2/1960 | France . |
| 2006541 | 12/1969 | France . |

*Primary Examiner*—David L. Lacey
*Assistant Examiner*—Thi Dang
*Attorney, Agent, or Firm*—Toren, McGeady & Associates

[57] ABSTRACT

An apparatus for treating, e.g., washing or filtering, fiber suspensions having a consistency of 8–20%, the apparatus including at least on rotatable filtering surface, an arrangement for feeding the suspension to a treatment region of the apparatus, and an arrangement for discharging the suspension from the treatment region, the feeding arrangement including at least one pressure chamber for fluidizing the suspension, at least one inlet duct for introducing the suspension to the chamber, and at least one feed duct for transferring the suspension from the pressure chamber to the treatment region.

12 Claims, 3 Drawing Sheets

APPARATUS FOR TREATING PULP

The present invention relates to a method and apparatus for treating medium consistency pulp in connection with different pulp treatment devices or apparatuses. Washers used for washing pulp are disclosed below as an example.

Several types of washing apparatuses and methods are known from the prior art. Known arrangements include diffusers, drum washers/disc washers and Fourdrinier washers, which clearly differ from each other. Pulp is fed into diffuser washers at a consistency of 10%. The feed consistency for drum washers and Fourdrinier washers is normally between 1 and 3%. Drum washers presently used are, for example, suction washers, wash presses and pressure washers.

A conventional suction washer includes a wire coated drum rotatable in a vat or drum. The casing of the drum includes collecting compartments beneath a perforated plate, which each communicate via their own pipe with the valve system on the shaft at the end of the drum. The filtrate is led from the valve through the drop leg to the filtrate chest. Due to the valve construction the suction effect of the drop leg may be arranged at different positions of the web formation.

Web formation in a suction washer is carried out by arranging —by means of a drop leg—reduced pressure inside the drum rotating in the vat, which reduced pressure draws pulp suspension from the vat and against the drum. The fibers of the pulp thicken on the surface of the drum when the liquid penetrates the drum. The consistency of the fiber suspension in the vat is about 0.5–2%, and the consistency of the pulp layer thickened on the drum is about 10–12%. The web formation zone, in other words the part of the rim of the drum, which in the vat is covered by fiber suspension, is about 140°. The maximum rotational speed of the drum is 2 to 2.5 r/min. If the rotational speed is higher the collecting compartments and pipes of the filtrate are not able to empty.

Washing is carried out as a displacement wash by showering washing liquid on the surface of the drum protruding from the vat, which due to the reduced pressure is absorbed through the pulp layer and displaces majority of the chemical liquid. The width of the displacement zone is approximately 120°. The typical specific square capacity of the suction washer is about 5 BDMT/m$^2$/d, wherein the thickness of the pulp web is about 25 mm. In bleaching, the square capacity of the suction washer is about 8 BDMT/m$^2$/d and the thickness of the web is about 30 mm.

A washer press comprises a drum with a wire coated or drilled perforated plate casing. The pulp feed is carried out at a consistency of 3 to 4% and the knots, unbeaten particles and respective undesired parts are to be discharged from the pulp prior to the washer. There are compartments on the casing of the drum, .from which the filtrate is led out via a chamber at the end rim. The drum may also be open so as to gather the filtrate in the drum and let it flow out through the opening at the end.

The length of the web formation stage is about 90° and that of the displacement stage about 150°. The rotational speed of the drum is about 2 r/min and the specific square capacity about 15 to 20 BDMT/m$^2$/d The consistency of the washed pulp may rise even to 30%, when a press roll is used. The displacement, however, takes place at the consistency of 10% the thickness of the pulp web being about 50 mm.

As an example of a pressure washer there may be mentioned an apparatus according to Finnish patent publication 71961, which mainly comprises a drilled perforated plate drum having 15 to 20 mm high mouldings attached on the surface at the distance of about 200 mm from each other. Filtering compartments are located on the casing of the drum beneath the pulp compartments. The outer rim at the end of the drum includes a valve arrangement through which the filtrate is discharged. The washer may have 3 to 5 stages, in other words the filtrates are led from stage to stage by pumping upstream. The chambers of the washing liquid between different stages are sealed.

Web formation is carried out by feeding pulp into the feed box, the bottom of which is formed by a perforated plate, on which an endless wire cloth is located. The feed box becomes lower towards the washing drum. Liquid is discharged from the pulp in the feed box through the wire cloth and the perforated plate and the pulp is thus thickened on the wire cloth. With the wire cloth moving towards the drum, liquid is continuously discharged from the suspension also due to the pressure caused by the lowered feed box. At the end of the feed box pulp is led to the compartments between the mouldings and axial "planks" of length of the drum are thus formed in the compartments. Immediately downstream of the feeding point, the drum has a first washing zone; the apparatus according to said patent publication has five separate zones. A flow of washing liquid is led to each zone, which when pressed through the pulp layer in the compartments of the washing drum displaces the previous liquid there. As mentioned above the filtrates are led upstream from one zone to another. In other words, pure washing liquid is pumped to the last washing zone and the displaced filtrate is led to the second last zone to operate as washing liquid there. Subsequent to the last washing zone the "pulp planks" are removed from the drum, for example, by compressed air blow and are transferred forwards with a screw conveyer.

The specific square capacity of this type of pressure washer when having four stages, is about 2.4 BDMT/m$^2$/d. The thickness a "pulp plank" is about 55 mm, and it can reach a consistency of 15 to 17%. The washing water flowing from the compartments, however, dilutes the consistency to 10 to 12 %. The consistency of the pulp being fed to the washing drum is 3 to 6%. The rotational speed being used with the drum is about 0.3 rpm.

All said apparatuses, apart from the diffusers are characterized in that the consistency of the pulp being fed to the washer is relatively low, at its maximum 6%. In other words the pulp is to be diluted prior to the washing to less than half of the value of the preceding treating stages, which is 10 to 15%. Thus the amount of liquid in the pulp at least doubles. If it were possible to carry out the washing at high consistency, savings might be gained both in the size of the equipment, in the energy consumption and also in the amount of the filtrate to be led for evaporation. The problem is, however, that there has not been appropriate equipment to feed high consistency, over 6%, pulp to the washer. On the other hand, it is also a known fact that when the pulp thickens the air content of the suspension grows and foam problems arise in the washing. Also other pulp treating devices, such as thickeners, have similar problems.

The object of the present invention is to eliminate or minimize these problems and to enable the treatment of pulp in the medium consistency zone of approximately 8 to 20%. The method and apparatus according to the invention removes air from the medium consistency pulp and feeds it in a controlled manner to the treating apparatus.

The method in accordance with the invention is characterized in that the feed of pulp into said apparatus, the treatment of pulp in said apparatus and its discharge and transfer further on is carried out at the consistency range of 8 to 20%.

The apparatus in accordance with the invention is characterized in that the devices for feeding pulp to the treatment apparatus comprise mainly at least one pressure chamber, at least one inlet duct of pulp to said chamber and at least one feed duct of pulp from said chamber to the apparatus.

Another embodiment of the apparatus according to the invention is characterized in that the devices for removing pulp from the treatment apparatus comprise a screw conveyer and a centrifugal pump arranged in close proximity to the discharge end of the screw.

The method and apparatus according to the invention are described in detail below, by way of example and with reference to the enclosed drawings, in which a washer is used as an example.

DETAILED DESCRIPTION OF THE DRAWINGS

Figure 1:
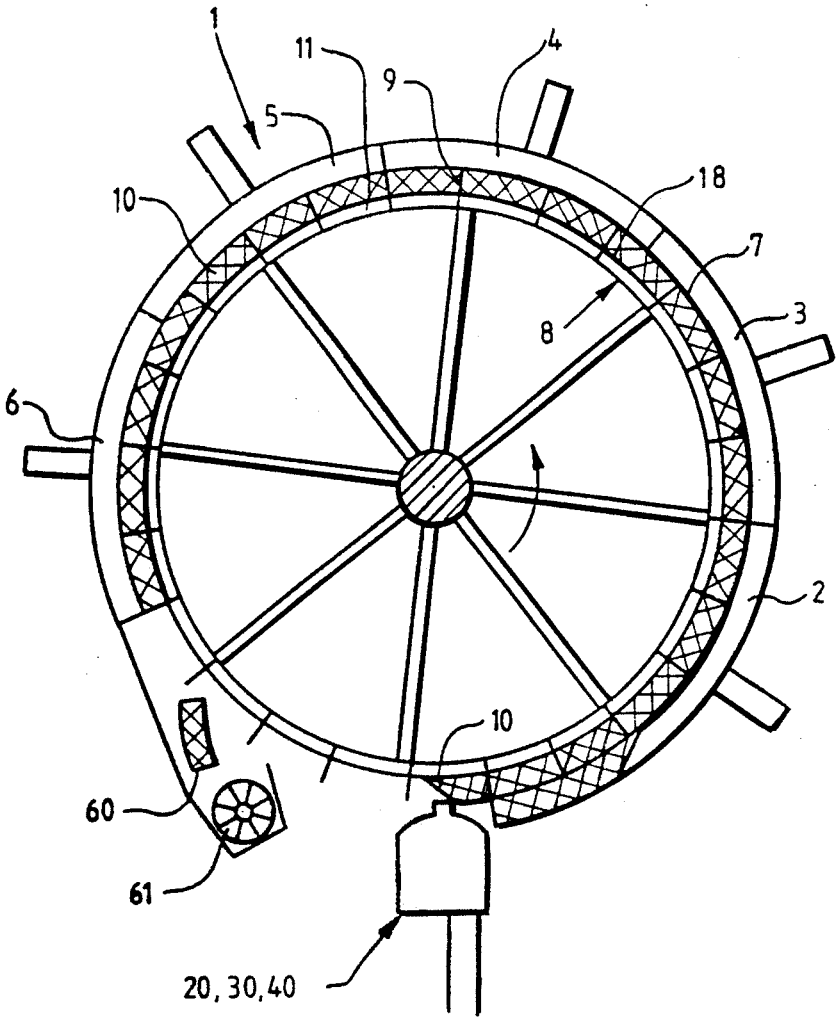
FIG. 1 is a schematic sectional view of a washing apparatus as treatment apparatus and according to a preferred embodiment.

A washer 1 according to FIG. 1 comprises, in principle, a drum in accordance with U.S. patent application No. 921,786, now U.S. Pat. No. 4,769,986, the outer rim of which is divided into chambers 2–6, to which conduits lead. The surface on the inner rim of the chambers 2–6 is formed by a drum 7 advantageously permeable to liquid. Inside this drum is a rotatably mounted cylinder 8 with a surface permeable to liquid on the outer rim 18. Axially extending, radial partition walls 9 protrude from the surface of the cylinder towards the surface of the drum 7, which partition walls form together with parts of the cylinder surfaces 7 and 8 pulp treating compartments 10. To the inside of the outer rim 18 of the cylinder 8 are arranged liquid chambers 11, from which liquid is led through a valve system (not shown) at the end of the washer from each washing zone (corresponding chambers 2–6) to the preceding zone. In other words from the last washing zone, from the area of chamber 6 to chamber 5, from the area of chamber 5 to chamber 4, etc.

Compared with the apparatus according to U.S. Pat. No. 4,769,986 changes have been made both to the feed and the discharge side of the washer of the present invention; these changes are also to be seen in the drawing. FIG. 1 shows a rough outline of a pulp feeding apparatus 20, which regardless of the type is characterized in that it is such as to make possible the feeding of pulp into the washer at the consistency of the pulp of the immediately preceding mass tower or the washing zone, in other words air free at a consistency of 8 to 20%.

Figure 2:
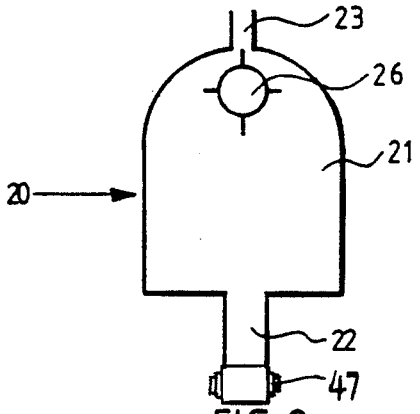
FIGS. 2–4 are schematic illustrations of advantageous feeding apparatuses.

FIG. 2 shows a feed apparatus comprising a pressure chamber 21, to which pulp is pumped from the mass tower, for example along duct 22, using a fluidizing centrifugal pump 47. The pulp conveyance equipment is advantageously provided with gas discharge. Thus the pulp flowing to the pressure chamber 21, the purpose of which is to divide in the horizontal direction the inflowing pulp uniformingly on the drum, does not include harmful amounts of air anymore, neither is there a risk of foaming of the filtrates in the successful washing. In the pressure chamber, close to the discharge opening 23 of the pulp, which may be a continuous slot of the length of the washing drum or a line of perforations, is located a fluidizing member 26, advantageously a rotor, which brings the pulp into a flowing state, and such is thus able to flow off through the discharge opening 23 to the compartments 10 of the washer. Member 26 may be either of the same length as the washer or each opening may have its own fluidizing element. By maintaining a slight continuous over pressure in the pressure chamber, air is prevented from mixing with the pulp at this stage.

Figure 3:
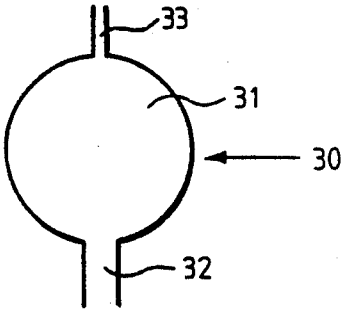

FIG. 3 discloses a feed apparatus 30 for pulp according to a second embodiment, in which apparatus pulp is pumped along a pipe 32 to an expansion or widening chamber 31, from which pulp is pressed along a narrow pipe or a flat duct 33 of reduced cross-sectional area relative to pipe 32 and flows to the compartments 10 of the washer. Due to the kinetic speed, pulp remains in the fluidized state and quickly and evenly fills compartments 10.

Figure 4:
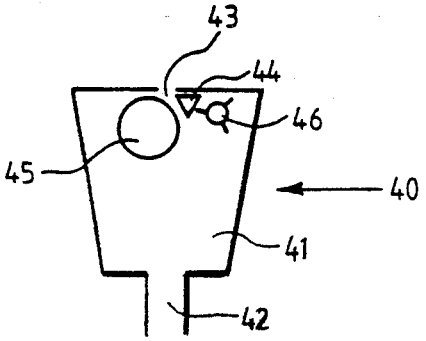

FIG. 4 discloses a pulp feed apparatus 40 forming a third embodiment and which comprises a pulp inlet duct 42 and a pressure chamber 41, inside of which is arranged at least one rotatable roll 45, which, together with plate 44, determines the size of the feed slot 43 for the pulp. Additionally, chamber 41 may have a fluidizing element 46 close to feed opening 43 to ensure flow of pulp from the opening to the compartments 10 of the washer, if the pressure of the chamber 41 and the rotating roll 45 alone are insufficient. The fluidizing member 46 may be a rotor or also some other type of a vibrator.

Figure 5:
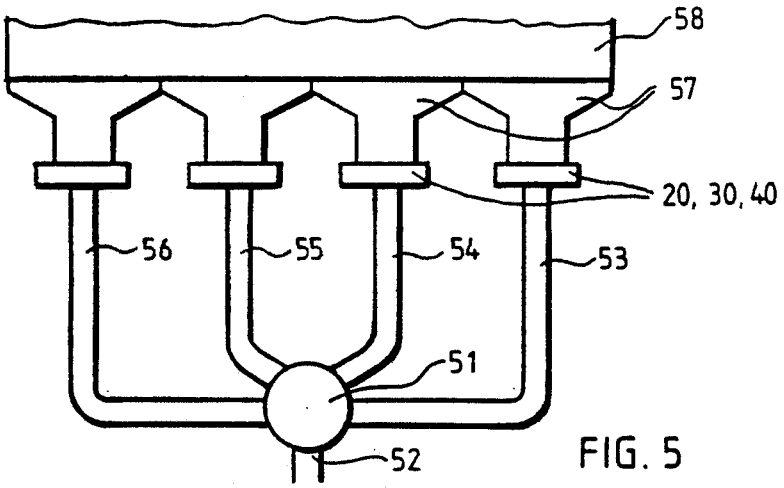
FIG. 5 is a schematic illustration of an arrangement for feeding pulp to a treatment apparatus at several positions.

FIG. 5 discloses yet another arrangement, in which feed of pulp to the washer is carried out only through a few feed openings to the whole length of the washing drum. In that case apparatus 51, for example, in accordance with the International patent application WO No. 86/04369 is used, by means of which the flow of high consistency pulp flowing from a pump (not shown) along the pipe 52 is divided into a plurality of flows via pipes 53–56. One of the described feed apparatuses 20, 30 or 40 is mounted at the washer side end, and the pulp flows from the feed apparatus is led by nozzles 57 to the feed box 58, in which the flows join to form one uniform web.

Figure 6:
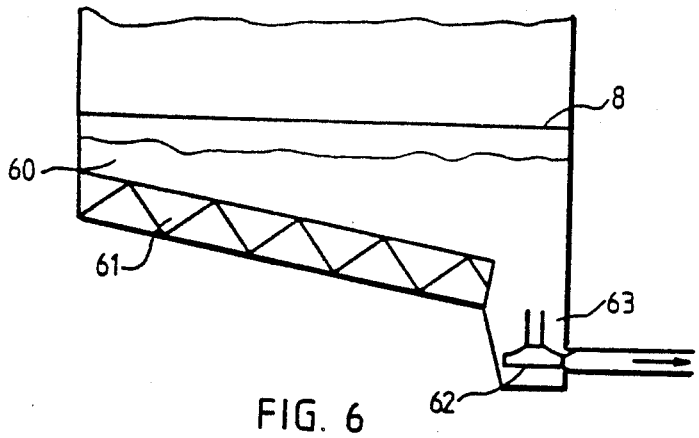
FIGS. 6 and 7 are schematic illustrations of two alternative ways for discharging pulp from a treatment apparatus.
Figure 7:
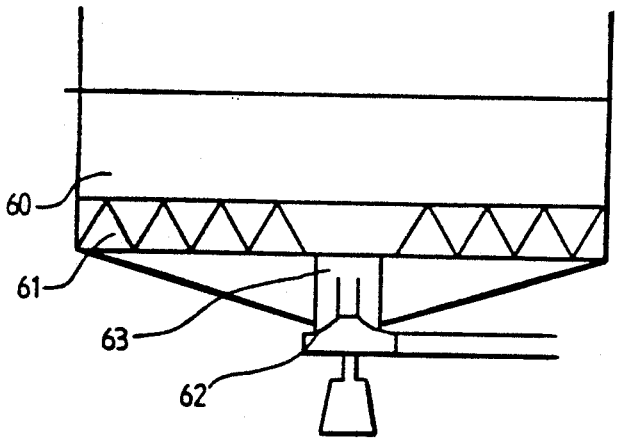

FIG. 1 also generally illustrates the discharge of pulp from the washer. FIGS. 6 and 7 show two embodiments for the discharge of the pulp from the washer and for the further transfer of pulp onwards.

In the arrangement according to FIG. 6, the pulp being removed from the washing drum 8 falls to a chute 60, at the bottom of which is arranged a screw conveyor 61, which transfers pulp to the collection chamber or vat 63 in front of the suction duct of a pump 62 for high consistency pulp, from which vat the fluidizing pump transfers the pulp for further treatment.

In the arrangement of FIG. 7 a pump 62 for high consistency pulp is arranged in the middle part of the washer, whereby screw conveyor 61 transfers pulp from the ends of the washer to the vat 63 for pump 62. Both sides of the screw conveyor naturally thus transfer pulp towards the middle parts of the washer.

It is of course possible to replace the screw 61 of FIG. 7 with two inclined screws, which feed pulp to the high consistency pump.

Figure 8:
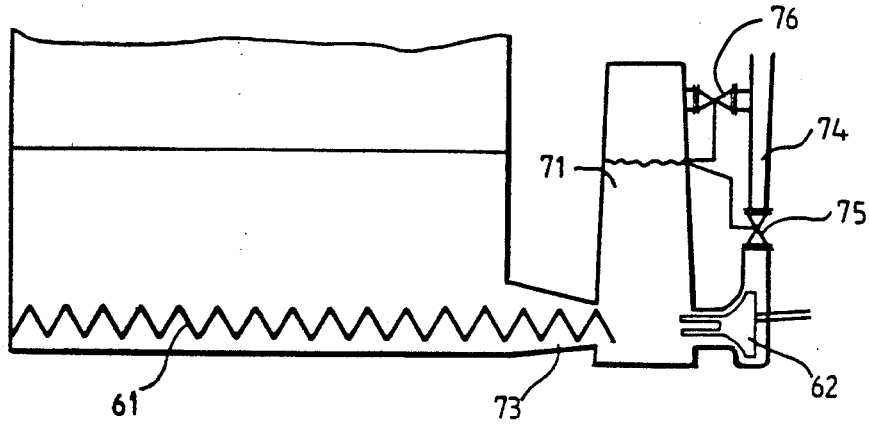
FIG. 8 is a schematic illustration of a third alternative way discharging pulp from a treatment apparatus.

FIG. 8 schematically illustrates yet another embodiment of a pulp discharge arrangement. Pulp is discharged from a treatment apparatus in a known way to screw 61, which transfers the pulp to a relatively small mass tower 71 arranged on the side of a treatment apparatus (cf. FIG. 7) or to the end (cf. FIG. 6), or more specifically, transfers pulp substantially to the lower part of tower 71 and advantageously at the same level as a centrifugal pump 62, which is arranged for transferring the pulp further. A cylindrical or advantageously slightly conical pipe portion 73 is arranged to surround screw 61 immediately prior to tower 71, the purpose of which pipe portion is to seal screw 61 so as not to allow pulp to discharge itself from the tower towards the treatment apparatus. Additionally, either a throttling valve 75 or possibly a adjustable back-circulation valve 76 is arranged to the discharge duct 74 of pump 62, which also ensures the maintenance of a sufficient surface level of pulp in tower 71.

One possible advantageous arrangement is to feed pulp with the screw directly to the suction opening of the pump, whereby the flow channel of pulp to the tower is a relatively small opening between the conveyor screw and the suction opening of the pump or, for example, on the casing of the conveyor screw. Such being the case, it would be possible to utilize the feed pressure produced by the screw at the suction opening of the pump. The above described embodiment has the advantage that considerable savings are achieved both in the costs of the equipment and in the delivery height of the pump. All the devices of the prior art have discharged the pulp to the drop leg, which is several meters high, most usually about 10 m, to ensure sufficient pressure in the suction opening of the pump for a successful pumping. Because the treatment apparatuses are most usually all at the same level, it has always been necessary to pump the pulp first back from the bottom before it has been possible to feed it to the next treatment apparatus.

When using the method and apparatus according to the invention for feeding pulp to a washer, for example, it is possible to utilize the surface of the drum better in the actual washing process, because the feed and discharge apparatuses cover only 60°, which leaves thereby 300° for the washing. Presuming that the thickness of the web of the drum is 30 mm and the rotational speed of the drum 7.5 rpm, the square capacity of the drum becomes more than 32 BDMT/$m^2$/d The outlet consistency may be even 15% without any risk of operational disturbances, because the discharge devices operate reliably at these consistencies. Thus it is possible to treat the pulp continuously at the consistency of 8 to 20% without a need to dilute it, for example, for the feed to the washer. At the same time it is possible to utilize the feature of a fluidizing centrifugal pump to remove air from high consistency pulp, by means of which the foaming of the filtrates in the washer is prevented or minimized.

As a conclusion it should be mentioned that the method and apparatus according to the invention may be applied not only to a washer, but also to other pulp treatment apparatuses, in which pulp is to be fed in the form of a web to the apparatus. Such pulp treatment apparatus may, for example, be a thickener. It must also be understood that although the above description deals only with the application of the invention solely to a drum type of pulp treatment apparatus, it is quite possible to also apply the invention to disc type treatment apparatuses, in other words to all such apparatuses in which the treatment of pulp is carried out on rotating filtering surfaces. Thus the above described example concerning a washer only has the purpose of showing what a considerable improvement the invention brings relative to the prior art and not that of restricting the invention of what is shown in the enclosed claims, which alone determine the scope of invention.

We claim:

1. An apparatus for treating fiber suspensions having a consistency of 8–20% , comprising:

at least one rotatable filtering surface;

a stationary counter surface, said at least one filtering surface and said stationary counter surface being arranged so as to form a treatment zone therebetween;

means for feeding said suspension to the treatment zone, said feeding means including at least one pressure chamber in which said suspension is fluidized, at least one inlet duct positioned for introducing said suspension to said at least one pressure chamber, and at least one feed opening positioned for transferring said suspension from said at least one pressure chamber to the treatment zone;

means for fluidizing said suspension positioned in said at least one pressure chamber so as to subject said suspension to a strong shear force field and to disrupt any fiber-to-fiber bonds; and means for discharging said suspension from said treatment zone.

2. An apparatus as defined in claim 1, and further comprising a fluidizing centrifugal pump provided with an air-discharge, and arranged so as to feed said suspension to said at least one pressure chamber via said at least one inlet duct.

3. An apparatus as defined in claim 1, wherein said at least one pressure chamber is constructed so that said suspension is web-like as it flows from said at least one feed opening.

4. An apparatus as defined in claim 1 and further comprising nozzles, branch pipes connecting said nozzles to said at least one pressure chamber, and a feed box located after said at least one pressure chamber and immediately prior to the treatment zone, said nozzles being connected between said branch pipes and said feed box, said at least one pressure chamber being arranged so as to divide said suspension into partial flows, said branch pipes being arranged so as to lead said partial flows to said nozzles, said nozzles being arranged so as to spread partial flows into webs which subsequently join in said feed box.

5. An apparatus as defined in claim 1, wherein said at least one rotatable filtering surface is a rotatable drum having filtering surfaces thereon, the surface of said drum being divided into compartments by means of radial ribs.

6. An apparatus as defined in claim 1, wherein said at least one rotatable filtering surface includes a plurality of at least one of rotating discs and disc sectors provided with filtering surfaces.

7. An apparatus as defined in claim 1, wherein said at least one inlet duct has a cross-sectional area which is larger than a total cross-sectional area of said at least one feed opening.

8. An apparatus for treating suspensions of the paper and pulp industry having a consistency of 8–20%, comprising:

at least one rotatable filtering surface;

a stationary counter surface, said at least one filtering surface and said stationary counter surface being arranged so as to form a treatment zone therebetween;

means for feeding said suspension to the treatment zone; and means for discharging said suspension from said treatment zone, said discharging means including a screw conveyor having a discharge end and a centrifical pump having a suction opening arranged immediately adjacent to said discharge end of said screw conveyor so as to feed said suspension from said screw conveyor directly to said suction opening.

9. An apparatus as defined in claim 8, further comprising a mass tower having a lower part, said discharge end of said screw conveyor being connected with the lower part of the mass tower and said discharge end of said screw conveyor and said suction opening of said pump being arranged so as to substantially join together.

10. An apparatus as defined in claim 9 and further comprising a casing which is either cylindrical or conical in shape, and is arranged so as to surround the discharge end of said screw conveyor.

11. An apparatus as defined in claim 8, and further comprising a mass tower having a bottom part, the discharge end of said screw conveyor being connected to the bottom part of said mass tower, and the centrifical pump being arranged in the connection between the discharge end of the screw conveyor and the bottom part of the mass tower.

12. An apparatus for treating fiber suspensions have a consistency of 8–20%, comprising:

at least one rotatable filtering surface;

a stationary counter surface, said at least one filtering surface and said stationary counter surface being arranged so as to form a treatment zone therebetween;

means for feeding said suspension to the treatment region, said feeding means including at least one pressure chamber in which said suspension is fluidized, at least one inlet duct positioned for introducing said suspension to said chamber, and at least one feed duct positioned for transferring said suspension from said at least one pressure chamber to the treatment zone, a narrowest measure of said at least one feed duct being significantly smaller than the diameter of said at least one pressure chamber;

means for fluidizing said suspension positioned in said at least one pressure chamber so as to subject said suspension to a strong shear force field and to disrupt any fiber-to-fiber bonds; and means for discharging said suspension from said treatment zone.

* * * * *